US006737128B2

(12) United States Patent
Kasahara

(10) Patent No.: US 6,737,128 B2
(45) Date of Patent: May 18, 2004

(54) INK-JET RECORDING SHEET, INK-JET RECORDING METHOD AND PREPARING METHOD OF INK-JET SHEET

(75) Inventor: Kenzo Kasahara, Hino (JP)

(73) Assignee: Konica Corporation (JP)

( * ) Notice: Subject to any disclaimer, the term of this patent is extended or adjusted under 35 U.S.C. 154(b) by 17 days.

(21) Appl. No.: 09/996,299

(22) Filed: Nov. 28, 2001

(65) Prior Publication Data

US 2002/0119296 A1 Aug. 29, 2002

(30) Foreign Application Priority Data

Nov. 29, 2000 (JP) ..... 2000-362591
Jul. 5, 2001 (JP) ..... 2001-204593

(51) Int. Cl.[7] ..... B41M 5/40

(52) U.S. Cl. ..... 428/32.31; 428/32.35; 428/32.38

(58) Field of Search ..... 428/32.31, 32.35, 428/32.38, 195, 213, 323, 327, 409

(56) References Cited

U.S. PATENT DOCUMENTS 4,460,637 A * 7/1984 Miyamoto et al. ..... 428/212
5,027,131 A * 6/1991 Hasegawa et al. ..... 346/1.1
5,576,088 A * 11/1996 Ogawa et al. ..... 428/327
6,001,463 A * 12/1999 Shibahara et al. ..... 428/216
6,183,844 B1 * 2/2001 Li ..... 428/212
6,203,899 B1 * 3/2001 Hirose et al. ..... 428/341
6,357,871 B1 * 3/2002 Ashida et al. ..... 347/106
6,495,242 B1 * 12/2002 Tsuchiya et al. ..... 428/195
6,503,604 B1 * 1/2003 Kasahara et al. ..... 428/195

* cited by examiner

*Primary Examiner*—B. Shewareged
(74) *Attorney, Agent, or Firm*—Muserlian, Lucas and Mercanti

(57) ABSTRACT

An ink-jet recording sheet comprising a first porous layer at the outermost position of the ink-jet recording sheet, wherein the ink-jet recording sheet satisfies the following Formula (1), when an aqueous solution, which comprises a water-soluble alcohol-type organic solvent having an SP value in an range of from 18.414 to 30.69 $(MPa)^{1/2}$ and a boiling point of not less than 120° C. in an amount of from 10 to 40%, is provided to the surface of the ink-jet recording sheet in an amount of 20 $ml/m^2$, $$Vc/Vd \leqq 0.4 \qquad \text{Formula (1)}$$

wherein each of Vc and Vd represents a water transition amount of a first area, where the aqueous solution is provided, and a second area, where the aqueous solution is not provided, respectively, during a contact time of 0.8 seconds when the recording material is subjected to Bristow's Measurement.

7 Claims, No Drawings

INK-JET RECORDING SHEET, INK-JET RECORDING METHOD AND PREPARING METHOD OF INK-JET SHEET

FIELD OF THE INVENTION

The present invention relates to an ink-jet recording sheet (hereinafter referred simply to as a recording sheet), and in more detail to an ink-jet recording sheet which exhibits excellent ink absorbance and results in minimized image degradation due to harmful gases. Further, the present invention relates to an ink-jet recording method in which recording is carried out by jetting ink and a preparing method of the recording material.

BACKGROUND OF THE INVENTION

Ink-jet recording is carried out in such a manner that fine ink droplets are jetted onto a recording sheet such as a paper sheet, employing various working principles so that images and text are recorded. Said ink-jet recording exhibits advantages such as relatively high speed, low noise, and easy multicolor reproduction.

Conventional drawbacks with nozzle clogging and maintenance in said recording method have been overcome due to improvement of both inks and devices. As a result, at present, said recording method has been increasingly applied to various fields such as various types of printers, facsimile machines, and computer terminals.

Recently, said printers have been particularly improved so as to produce high quality images which approach conventional photographic image quality. Accordingly, needed are recording sheets capable of realizing conventional photographic quality and of further reproducing conventional photographic print-like properties (glossiness, smoothness and toughness).

In order to reproduce such conventional photographic print-like properties, developed as conventional recording sheets have been so-called swelling type sheets which are prepared by applying hydrophilic binders such as gelatin and polyvinyl alcohol onto a support. However, said sheets exhibit drawbacks such as slow ink absorption, surface stickiness after printing, and ease of image bleeding due to the presence of moisture during storage. Particularly, it is very difficult to reach the conventional photographic image quality due to the fact that since the ink absorption rate is low, prior to ink absorption, ink droplets are blended with each other, tending to result in bleeding between different colors and beading within the same colors.

Instead of said swelling type recording sheets, a so-called porous type recording sheet has now been playing a major role. Said porous type recording sheet exhibits a feature in that since ink is absorbed into multiple fine voids, the ink absorption rate is high. Examples of recording sheets, which achieve conventional photographic image quality, as well as conventional photographic print-like properties, as described above, are described in Japanese Patent Publication Open to Public Inspection Nos. 10-119423, 10-119424, 10-175364, 10-193776, 10-193776, 10-217601, 11-20300, 11-106694, 11-321079, 11-348410, 10-178126, 11-348409, 2000-27093, 2000-94830, 2000-158807, and 2000-211241.

On the other hand, in addition to said image quality and conventional-print like properties, higher level of durability as well as image retention properties has been demanded and much researches has been conducted to improve light fastness, moisture resistance, and water resistance to the level of silver halide photography. For example, regarding improvement of the light fastness, many techniques are disclosed in Japanese Patent Publication Open to Public Inspection Nos. 57-74192, 57-87989, 57-74193, 58-152072, 64-36479, 1-95091, 1-115677, 3-13376, 4-7189, 7-195824, 8-25796, 11-321090, 11-277893, 2000-37951.

In addition to the light fastness problem, porous type recording sheets have a problem in which, due to the multiple-void structure, discoloration and fading tend to occur due to harmful gases. Water-soluble phthalocyanine based dyes, which are employed in common color ink-jet printers, tend to result in said problem.

The mechanism of said discoloration and fading has not yet been fully clarified. However, it is assumed that a very small amount of active harmful gases such as ozone, oxidants, $SO_x$, and $NO_x$ in ambient air decomposes said dyes, since the multiple-void structure has a large surface area and an active surface of inorganic fine particles.

Techniques for reducing said discoloration and fading are described in Japanese Patent Publication Open to Public Inspection Nos. 63-252780, 64-11877, 1-108083, 1-216881, 1-218882, 1-258980, 2-188287, 7-237348, 7-266689, 8-164664, and others. However, recording sheets for producing photographic image quality, utilizing a finer multiple-void structure than conventional, tend to be more readily degraded. Accordingly, conventional improvement techniques have not resulted in sufficient effects and more essential improvement has been demanded.

Said swelling type recording sheets tend to result in fewer such problems, but exhibit inherent difficulty to improve the low ink absorption rate.

It is possible to overcome discoloration and fading problems by utilizing an ink-jet recording method in which a pigment-based ink is used. However, drawbacks such as bronzing on the recording sheet surface have not been overcome so as to result in sufficiently acceptable image quality in terms of overall product quality. Further, the following gas insulation methods are very effective: prints are subjected to a lamination treatment or placed in a frame, or as described in Japanese Patent Publication Open to Public Inspection Nos. 53-27426, 59-222381, 62-271781, 11-157207, 11-245507, and 2000-71608, recording sheets, comprising fine thermoplastic particles on the surface, are printed, and subsequently heated or pressed to result in formation of a gas insulation layer. However, each of said methods needs a post-treatment to result in an additional manufacturing process. Specifically, in ink-jet recording employing a large-sized sheet at a width of at least 60 cm, lamination and heat roll treatments are troublesome and special devises are expensive. Accordingly, it can be safely assumed that said methods are not generally employed.

Japanese Patent Publication Open to Public Inspection No. 63-60784 describes an ink-jet recording media comprising a porous layer having organic fine particles and inorganic fine particles. However, the organic fine particles disclosed in the Japanese Publication are only capable of being dissolved in a special solvent having high solubility, and cannot dissolved in organic solvents, which are used in conventional inks for ink-jet recording. Therefore, such ink-jet recording medias cannot be used in conventional ink-jet recording.

From the viewpoints of the foregoing, the present invention has been achieved. An object of the present invention is to minimize image degradation due to harmful gases without applying any additional process to an ink-jet recording sheet having a high ink absorption rate.

SUMMARY OF THE INVENTION

The object of the present invention has been achieved employing the following embodiments.

[Structure 1]

An ink-jet recording sheet comprising a first porous layer at the outermost position of the ink-jet recording sheet, wherein the ink-jet recording sheet satisfies the following Formula (1), when an aqueous solution, which comprises a water-soluble alcohol-type organic solvent having an SP value in a range of from 18.414 to 30.69 $(MPa)^{1/2}$ and a boiling point of not less than 120° C. in an amount of from 10 to 40%, is provided to the surface of the ink-jet recording sheet in an amount of 20 $ml/m^2$, $$Vc/Vd \leqq 0.4 \qquad \text{Formula (1)}$$

wherein Vc represents a water transition amount of a first area of the ink-jet recording sheet, where the aqueous solution is provided, during a contact time of 0.8 seconds when the first area is subjected to Bristow's Measurement, and Vd represents a water transition amount of a second area of the ink-jet recording sheet, where the aqueous solution is not provided, during a contact time of 0.8 seconds when the second area is subjected to Bristow's Measurement.

[Structure 2]

The ink-jet recording sheet of Structure 1, wherein the ink-jet recording sheet further satisfies the following Formula (2), $$V60/Vd \geqq 0.7 \qquad \text{Formula (2)}$$

Vd represents a water transition amount of the ink-jet recording sheet during a contact time of 0.8 second when the ink-jet recording sheet is subjected to Bristow's Measurement after being stored at 60° C. and 20 RH for 24 hours.

[Structure 3]

The ink-jet recording sheet of Structure 1, wherein the first porous layer comprises a water-insoluble organic fine particles, which is capable of being dissolved in or swelled by a water-soluble alcohol-type organic solvent having an SP value in a range of from 18.414 to 30.69 $(MPa)^{1/2}$ and a boiling point of 120° C. or more, as a primary component, and the ink-jet recording sheet further comprises a second porous layer comprising inorganic fine particles and a hydrophilic binder as a primary component.

[Structure 4]

The ink-jet recording sheet of Structure 3, wherein a mean primary diameter of the water-insoluble organic fine particles is not more than 0.1 $\mu$m.

[Structure 5]

The ink-jet recording sheet of Structure 3, wherein the ink-jet recording material comprises a non-water-absorptive support.

[Structure 6]

The ink-jet recording sheet of Structure 1, wherein the water-soluble alcohol-type organic solvent is diethylene glycol monobutyl ether.

[Structure 7]

The ink-jet recording sheet of Structure 6, wherein the first porous layer comprises water-insoluble organic fine particles, which is capable of being dissolved in or swelled by diethylene glycol monobutyl ether, as a primary component, and a mean primary diameter of the water-insoluble organic fine particles is not more than 0.1 $\mu$m.

[Structure 8]

The ink-jet recording sheet of Structure 6, wherein the ink-jet recording sheet comprises a non-water-absorptive support.

[Structure 9]

The ink-jet recording sheet of Structure 1, wherein the first porous layer comprises organic fine grains as a primary component.

[Structure 10]

The ink-jet recording sheet of Structure 1, wherein the ink-jet recording sheet comprises a non-water-absorptive support.

[Structure 11]

An ink-jet recording sheet comprising an ink-absorbing layer having a first porous layer at the outermost position of the ink-absorbing layer, wherein the ink-absorbing layer comprises water-insoluble organic fine particles which is capable of being dissolved in or swelled by a water-soluble alcohol-type organic solvent having an SP value in a range of from 18.414 to 30.69 $(MPa)^{1/2}$ and a boiling point of 120° C. or more.

[Structure 12]

The ink-jet recording sheet of Structure 11, wherein the first porous layer comprises the water-insoluble organic fine particles as a primary component.

[Structure 13]

The ink-jet recording sheet of Structure 12, wherein the ink-absorbing layer comprises a second porous layer contains inorganic fine particles and a hydrophilic binder as a primary component, and a thickness of the first porous layer is not more than 20% of the entire ink-absorbing layer and a thickness of the second porous layer is not less than 80% of the entire ink-absorbing layer.

[Structure 14]

An ink-jet recording method comprising steps of jetting an ink having a water-soluble dye, water and water soluble organic solvent onto an ink-jet recording sheet comprising a first porous layer at the outermost position of the ink-jet recording sheet in an amount of 10 to 35 $ml/m^2$, and drying the at room temperature until reaching a constant state, wherein the ink and the ink-jet recording sheet satisfy the following Formula (3), $$Va/Vb \leqq 0.4 \qquad \text{Formula (3)}$$

wherein Va represents a water transition amount of a first area of the ink-jet recording sheet, where the ink is provided in said amount, during a contact time of 0.8 seconds when the first area is subjected to Bristow's Measurement, and Vb represents a water transition amount of a second area of the ink-jet recording sheet, where the ink is not provided, during a contact time of 0.8 seconds when the second area is subjected to Bristow's Measurement.

[Structure 15]

The ink-jet recording method of Structure 14, wherein the water-soluble organic solvent is a water-soluble alcohol-type organic solvent having an SP value in a range of from 18.414 to 30.69 $(MPa)^{1/2}$ and a boiling point of 120° C. or more, and the first porous layer comprises a water-insoluble organic fine particles which is capable of being dissolved in or swelled by the water-soluble alcohol-type organic solvent.

[Structure 16]

The ink-jet recording method of Structure 15, wherein the water-soluble alcohol-type organic solvent is triethylene glycol monobutyl ether.

[Structure 17]

An ink-jet recording method of jetting an ink comprising a water-soluble dye, water and a water-soluble alcohol-type organic solvent having an SP value in a range of from 18.414 to 30.69 $(MPa)^{1/2}$ and a boiling point of not less than 120° C. onto an ink-jet recording sheet comprising a first porous layer at the outermost position of the ink-jet recording sheet, wherein the first porous layer contains a water-insoluble organic fine particles, which is capable of being dissolved in or swelled by the water-soluble alcohol-type organic solvent, as a primary component.

[Structure 18]

The ink-jet recording method of Structure 17, wherein the water-soluble alcohol-type organic solvent is triethylene glycol monobutyl ether.

[Structure 19]

A method for preparing the ink-jet recording sheet of Structure 1 comprising steps of coating a coating solution comprising an organic fine particle emulsion, which satisfies the following Formula 4, and drying the coated solution, $$T0 \geqq 60 \text{ and } T20 \leqq 10 \qquad \text{Formula (4)}$$

wherein T0 is a minimum film forming temperature (in ° C.) of the organic fine particle emulsion and T20 is the minimum film forming temperature (in ° C.) of the organic fine particle emulsion when a hydrophilic organic solvent is added to the organic fine particles emulsion in and amount of 20 percent by weight of the organic fine particle emulsion.

The present invention will now be detailed below.

The recording sheets employed in the present invention preferably have a relatively high ink absorption rate to realize conventional photographic quality. Therefore, at least the outermost surface preferably possesses multiple-void structure. Said recording sheets more preferably have a porous ink absorptive layer as the outermost layer which is formed by said ink absorptive layer on the support.

It is possible to confirm the shape of voids through observation employing an electron microscope.

It is preferable that voids are not isolated, but are connected to each other so as to provide a passage among them. In this case, void diameter may be defined as the diameter which is determined employing, for example, a mercury pressure inclusion method.

In said porous type recording sheets, any spaces between packed fine particles are generally regarded as voids. Accordingly, it is also possible to express said void diameter based on the size of packed particles and the packing ratio. The particle size employed in the present invention is preferably from 0.01 to 1 $\mu$m, and is more preferably from 0.02 to 0.1 $\mu$m, while the void ratio is preferably from 10 to 70 percent, and is more preferably from 20 to 60 percent.

The ink-jet recording sheet, described in Structure 1, will now be described.

Said ink-jet recording sheet is characterized in comprising porous layer having a multiple-void structure on the outermost position of the ink-jet recording sheet and satisfying $Vc/Vd \leqq 0.4$.

Vc is the water transition amount during a contact time of 0.8 second, when the area of said ink-jet recording sheet, which is provided with an aqueous solution containing a water-soluble alcohol-type organic solvent, having an SP value of 18,414 to 30.69 $(MPa)^{1/2}$ and a boiling point of at least 120° C., in an amount of 10 to 40 percent by weight, is provided onto the surface of said ink-jet recording sheet at a rate of 20 $ml/m^2$ and subsequently dried at room temperature until reaching a constant state, is subjected to measurement according to the Bristow's Measurement, and Vd is the water transition amount during a contact time of 0.8 second when the non-aqueous solution provided area of said recording sheet is subjected to Bristow's Measurement. Namely, it is necessary that the water absorption rate of the area provided with said aqueous solution is less than that of the non-recorded area. The resulting decrease ratio (the ratio of the amount of absorbed water before and after the treatment) is preferably no more than 40 percent, and is more preferably no more than 20 percent.

Selected as water-soluble alcohol-type organic solvents employed in said aqueous solution are those which are water-soluble alcohol-type organic solvents described in Structure 1 and have an SP value of 18.414 to 30.69 $(MPa)^{1/2}$ and a boiling point of at least 120° C. Preferably, water-soluble alcohol-type organic solvents having the SP value of 18.414 to 25.575 and a boiling point of at least 180° C. are used. The upper limit of said boiling point is not particularly limited, but those having a melting point of no higher than 30° C. are preferred. As the water-soluble alcohol-type organic solvent in the aqueous solution, diethylene glycol monobutyl ether is preferably used.

Incidentally, said Bristow's Measurement is carried out based on "Method for Determining the Liquid Absorbability of Paper and Board (Bristow's Method) (refer to J. TAPPI Paper and Pulp Test Method No. $51_{-87}$). In the present invention, as the liquid for Bristow Test, water is used. However, for the purpose to make said measurement easier, water may be tinted by dissolving a very small amount of dyes. In the present invention, water containing in an amount of not more than 0.1% of dyes regarded as water.

The amount of liquid transfer with Bristow Test is explained below. This test method specifies a method for measuring liquid absorbing behavior of paper and board in a short period of time. A Bristow Test Machine Type II (compression type) manufactured by Kumagai Riki Kogyo Co., Ltd. was employed, by which a transfer amount (m1/m2) during a contact duration of 0.8 second was obtained as a void volume.

"Dried at room temperature until reaching a constant state", as described in the present invention, means that moisture evaporation reaches equilibrium with general atmosphere. Preferably, referred to is a state after approximately one hour at 23° C. and 55 percent relative humidity, since an ink or an aqueous solution is provided.

Further, an ink-jet recording sheet was successfully developed which exhibited the following properties. By adjusting said ink-jet recording sheet to satisfy $V60/Vd \geqq 0.7$ in the aforementioned Structure 2, it was possible to effectively minimize discoloration and fading in areas recorded with less ink of an ink-jet recorded sheet. Further, it was possible to effectively minimize said discoloration and fading during winter when ambient temperature was low after printing.

From the viewpoint of obtaining the aforementioned effects of the present invention, it is preferable that the V60/Vd value be no less than 0.7 and the Vc/Vd value be no more than 0.3. Further, said V60/Vd value is preferably in the range of $0.7 \leqq V60/Vd \leqq 1.5$.

The ink-jet recording sheet, described in Structure 11, will now be described.

Said ink-jet recording sheet is characterized in comprising a porous layer comprising water-insoluble organic fine particles which are dissolved in or swelled by water-soluble alcohol-type organic solvents having an SP value of 18.414 to 30.69 $(MPa)^{1/2}$ and a boiling point of at least 120° C.

Selected as said water-soluble alcohol-type organic solvents employed in said aqueous solution are those which are have an SP value of 18.414 to 30.69 $(MPa)^{1/2}$ and a boiling point of at least 120° C. The upper limit of said boiling point is not limited, but those having a melting point of no higher than 30° C. are preferred.

Further, the organic fine particles dissolved in or swelled by said water-soluble alcohol-type organic solvents are selected, as said organic fine particles.

In the ink-jet recording sheet described in Structure 11, in order to effectively minimize discoloration and fading, it is preferable that $Vc/Vd \leqq 0.4$, specified in the ink-jet recording sheet described in Structure 1, be satisfied.

The preferable state of ink-jet recording onto the ink-jet recording sheet of the present invention is as follows. Voids in the porous layer, which have been present before providing said aqueous solution, result in the following after providing the same: 1. voids disappear, 2. the number of voids decreases, and 3. the void diameter decreases.

Of these, "2. the number of voids decreases" is preferred. It is preferable that the height of the maximum peak, which is located between 0.01 to 1 $\mu$m of the void size distribution, decreases to no more than 40 percent.

Further, "3. the void diameter decreases" is also preferred. When the maximum peak, which is located between 0.01 to 1 $\mu$m of said void size distribution, is regarded as the void diameter, it is preferable that said void diameter decreases to no more than 60 percent after recording compared to before recording.

However, most preferred is "1. voids disappear", in such a manner that when the surface of the recorded area is observed after recording, employing an electron microscope, voids are not noticed.

Further, considered as preferable structures to realize the shape variation of voids as above are those, described below.

After ink is provided onto a recording sheet, water in said ink gradually evaporates. On the other hand, water-soluble organic solvents evaporate slowly, and the ratio of said water-soluble organic solvents, remaining in said recording paper as a liquid, gradually increases. Namely, dissolution of water-insoluble substances, which are soluble in said water-soluble alcohol-type organic solvents, starts as said ink is dried. Namely, when ink-jet recording is carried out employing a recording sheet comprising "water-insoluble organic fine particles which are dissolved in or swelled by water-soluble alcohol-type organic solvent in said ink", after drying said ink, it is possible to seal voids or decrease the void diameter while some or all of the organic fine particles are dissolved in or swelled by the water-soluble alcohol-type organic solvent.

Further, a porous layer comprised of fine hydrophobic organic particles as the primary component such as polystyrene may be provided in said recording sheet, and plasticizers such as phthalic acid esters are incorporated into the second layer neighboring the porous layer and provided between the porous layer and the support. It is preferable that the porous layer is provided at the outermost position of the recording sheet. When ink is provided to the resulting recording sheet, said plasticizers are dissolved in the water-soluble solvents in said ink and are allowed to diffuse. As a result, said organic fine particles are subjected to plasticization and film forming and are capable of sealing voids and decreasing the void diameter.

Further, a porous layer comprising organic fine particles comprised of alkali-soluble resins such as hydroxypropyl methyl cellulose as the primary component may be provided in the recording sheet, and organic bases, which are water-insoluble and are diffusible in the presence of water-soluble organic solvents in said ink, are incorporated into the second layer neighboring the porous layer and provided between the porous layer and the support. It is preferable that the porous layer is provided at the outermost position of the recording sheet. When an ink is provided onto the recording sheet, after drying, said organic bases are dissolved in the water-soluble organic solvent in said ink and diffused to increase the pH of the porous layer and dissolve organic fine particles, whereby it is possible to seal voids and decrease the void diameter.

Further, in the same manner, a porous layer comprising organic fine particles comprised of alkali-soluble resins as the primary component may be provided in the recording sheet, and chelating agents, which are barely soluble in water and are diffusible in the presence of water-soluble organic solvents in the ink, are incorporated into the second layer neighboring the porous layer and provided between the porous layer and the support, and further, metal hydroxides such as zinc hydroxide which are insoluble in water, are incorporated into third layer neighboring the second layer and provided between the second layer and the support. It is preferable that the porous layer is provided at the outermost position of the recording sheet. When the ink is provided onto the recording sheet, after drying, said chelating agents diffuse and result in a chelating reaction with metals in metal hydroxides. Due to this reaction, alkali is generated to increase the pH of the porous layer and dissolve said organic fine particles, whereby it is possible to seal the voids or decrease the void diameter.

(Ink)

Said ink comprises water-soluble dyes, water, and water-soluble organic solvents. If desired, other additives may be incorporated into said ink. Specifically, water-soluble organic solvents are incorporated without fail for the purpose of minimizing dye deposition near nozzles due to drying. Said water-soluble organic solvents are any of the organic solvents which are soluble in water, and may be employed in combination. The boiling point of said organic solvents is preferably 120° C. or higher. Further, it is preferable that water-soluble organic solvents having an SP value of 18.414 to 30.69 $(MPa)^{1/2}$ are incorporated in an amount of 10 to 30 percent.

The SP value, as described herein, refers to the solubility parameter and is an important scale to estimate the solubility of substances. In the present invention, as the unit of the SP value, $(MPa)^{1/2}$, which is a value at 25° C., is used. Said SP values of organic solvents are described on page IV-337 of J. Brandrup, et al., "Polymer Handbook", A Wiley-Interscience Publication, and other publications. As the unit of the SP value, $(cal/cm^3)^{1/2}$ may be used. 18.414 to 30.69 $(MPa)^{1/2}$ corresponds to 9 to 15 $(cal/cm^3)^{1/2}$.

The water-soluble alcohol-type organic solvent, in the present invention, represents a water-soluble organic solvent, which has at least one alcoholic hydroxyl group in the molecule, including a polyvalent alcoholic compound and a polyvalent alcoholic compound, which is partially alkyl-esterificated. Listed as examples of water-soluble alcohol-type organic solvents are butanol, isobutanol, secondary butanol, tertiary butanol, pentanol, hexanol, cyclohexanol, benzyl alcohol, ethylene glycol, diethylene glycol, triethylene glycol, polyethylene glycol, propylene glycol, dipropylene glycol, polypropylene glycol, butylene glycol, hexanediol, pentanediol, glycerin, hexanetriol, thioglycol, ethylene glycol monomethyl ether, ethylene glycol monoethyl ether, ethylene glycol monobutyl ether, ethylene glycol dimethyl ether, diethylene glycol monomethyl ether, diethylene glycol monoethyl ether, diethylene glycol monobutyl ether, diethylene glycol dimethyl ether, diethylene glycol diethyl ether, triethylene glycol monoethyl ether, triethylene glycol monomethyl ether, triethylene glycol monobutyl ether, triethylene glycol diethyl ether, triethylene glycol dimethyl ether, tetraethylene glycol monomethyl ether, tetraethylene glycol monoethyl ether, tetraethylene glycol monobutyl ether, tetraethylene glycol dimethyl ether, and tetraethylene glycol diethyl ether.

Particularly preferred water-soluble alcohol-type organic solvents are polyhydric alcohol and alkyl ethers of polyhydric alcohols, and 2 or 3 types are preferably selected from them.

Preferably employed as water-soluble alcohol-type organic solvents having an SP value (being a solubility parameter) in the range of 18.414 to 30.69 $(MPa)^{1/2}$ among the water-soluble alcohol-type organic solvents according to the present invention, are ethylene glycol, diethylene glycol, triethylene glycol, diethylene glycol monobutyl ether, and triethylene glycol monobutyl ether. Of these, diethylene glycol (having an SP value of 19.437 $(MPa)^{1/2}$ and a boiling point of 230° C.) and triethylene glycol monobutyl ether are still preferably employed and diethylene glycol monobutyl ether is most preferably employed.

Said ink comprises at least one of the water-soluble dyes such as direct dyes, acidic dyes, basic dyes, reactive dyes or food dyes which are known in the art of ink-jets. The concentration of dyes in said ink is commonly from 0.1 to 5 percent.

In order to improve wet ability to recording sheets, the surface tension of said ink is commonly in the range of 25 to 60 dyn/cm at 20° C., and is preferably in the range of 30 to 50 dyn/cm.

In order to improve solubility dyes in said ink, it is preferable that the pH be maintained at no lower than 7. In order to adjust the pH to the desired value, pH regulators may be employed.

Listed as other additives of said ink are, for example, sequestering agents, antifungal agents, viscosity modifying agents, surface tension adjusting agents, wetting agents, surface active agents, and antirusting agents. The concentration of these additives in said ink is generally from 0.01 to 5 percent.

The maximum ink ejection amount is preferably no more than 35 $ml/m^2$. When the ejection amount exceeds said value, it is necessary to increase the thickness of the coating layer to increase the ink absorption capacity. As a result, various problems, such as cracking, occasionally occur The maximum ink ejection amount is preferably no more than 25 $ml/m^2$.

The ink-jet recording method described in Structure 14 will now be described.

When ink-jet recording is carried out by jetting ink comprised of water-soluble dyes, water, and water-soluble organic solvents onto an ink-jet recording sheet having porous layer having a multiple-void structure on the outermost position of the recording sheet, said ink-jet recording method is characterized in that the relationship between said ink-jet recording sheet and said ink satisfies the formula described below.

$$Va/Vb \leqq 0.4$$

wherein Va is the water transition amount during a contact time of 0.8 second, when the recorded area of said ink-jet recording sheet, which has been recorded on at an ink ejection amount of 10 to 35 $ml/m^2$, and subsequently dried at room temperature until reaching a constant state, is subjected to Bristow's Measurement, and Vb is the water transition amount during a contact time of 0.8 second when the non-recorded area of said recording sheet is subjected to Bristow's Measurement.

(Ink-Jet Recording Sheet)

It is required that a ratio of the water transition amount (Va/Vb) of the recorded surface of said ink-jet recording sheet to that of the non-recorded surface during a contact time of 0.8 second of said Bristow's Measurement is no more than 0.4. Namely, it is required that the water absorption amount decreases. The ratio said decrease is preferably no more than 40 percent, and is more preferably no more than 20 percent.

During drying of the ink-jet recording sheet described in Structure 14 after recording, for the purpose of accelerating drying, heat sources as well as blowers may be employed. However, from the viewpoint of additional load due to devices and processes, natural drying is preferred.

The ink-jet recording method, described in Structure 17, will now be described.

Said ink-jet recording method is characterized in that recording is carried out onto the ink-jet recording sheet comprising a porous layer, which has a multiple-void structure and is provided at the outermost position of the recording sheet, comprising fine water-insoluble organic particles as the primary component which is capable of being dissolved in or swelled by the water-soluble alcohol-type organic solvent having an SP value in a range of from 18.414 to 30.69$(MPa)^{1/2}$ and a boiling point of not less than 120° C., employing an ink comprised of water-soluble dyes, water, and the water-soluble alcohol-type organic solvents. Incidentally, the primary component in a layer, as described in the invention, means that its concentration is more than 50 percent to 100 percent by weight with respect to solids in the layer, more preferably more than 75 percent to 100 percent by weight with respect to solids in the layer.

"Water-insoluble organic fine particles (occasionally, simply referred to as organic fine particles), which are dissolved in or swelled by water-soluble organic solvent in the ink" are preferably comprised of polymers having a molecular weight of at least 5,000. Said polymers are selected from among those known in the art, such as polyvinyl chloride, polyvinylidene chloride, polyacrylate, polymethacrylate, elastomer, ethylene-vinyl acetate copolymers, styrene-acryl copolymers, styrene-methacrylate copolymers, polyester, polyvinyl ether, polyvinyl acetal, polyamide, polyurethane, polyolefin, SBR, NBR, polytetrafluoroethylene, chloroprene, proteins, polysaccharides, rosin ester, and ceramic resins. Particularly preferable materials of said organic fine particles are polyvinyl acetal based resins, polyurethane based resins, rosin ester based resins, acrylate based resins, methacrylate based resins, and SBR. Resins, which are prepared by modifying or copolymerizing at least two monomers, are also preferably employed. Resins may be employed which are added with the specified modification group or from which a leaving group is removed. Said organic fine particles may be prepared by blending at least two materials, and further, at least two types of organic fine particles may be blended and employed.

"Be dissolved", as described in the invention, refers to the state in which organic fine particles and water-soluble alcohol-type organic solvents are subjected to equilibrium to form a single phase, while "be swelled", as described herein, refers to the state in which organic fine particles absorb said water-soluble alcohol-type organic solvents to result in two times increase in volume compared with before absorbing. The volume increase ratio, when swelled, is preferably from 2 to 8 times.

Said organic fine particles should be insoluble in water so that they are not dissolved during ink-jet recording. However, they are allowed to absorb water at an amount range in which the ink absorption rate is not adversely affected. They may absorb water up to 20 percent with respect to their weight.

Cross linking agents may be incorporated into said organic fine particles at an amount range in which dissolution in, or swelling by, water-soluble organic solvents is not adversely affected. Irrespective of organic or inorganic materials, cross-linking agents, which have been known in the art, may be employed.

The particle diameter of said organic fine particles markedly affect the surface gloss of recording sheets. The number average particle diameter is preferably from 0.001 to 2 μm, more preferably from 0.01 to 1 μm, and still more preferably 0.01 to 0.1 μm. In the present invention, following method is used to determine said number average particle diameter. The cross-section as well as the surface of the particle containing layer is observed employing an electron microscope, and each diameter of many randomly selected particles is determined and the simple average (number average) is calculated. The diameter of each particle is the diameter of a circle having the same area as the projection area of said particle. The shape of said organic fine particles is not necessarily spherical but may be acicular or tabular.

Further, in order to effectively minimize discoloration as well as fading, it is preferable that the relationship between said ink-jet recording sheet and said ink satisfies $Va/Vb \leqq 0.4$ in the ink-jet recording method in Structure 12.

The particularly preferable embodiments in the ink-jet recording sheet of the present invention are that at least 80 percent of thickness of the entire ink absorptive layer is the thickness of the porous layer comprising inorganic fine particles as well as hydrophilic binders as the primary components; no more than 20 percent of thickness of the entire ink absorptive layer is the thickness of the porous layer comprising fine water-insoluble organic particles which are dissolved in or swelled by water-soluble alcohol-type organic solvents having an SP value in a range of from 18.414 to 30.69 $(MPa)^{1/2}$ and a boiling point of at least 120° C.; and further, the porous layer, comprising said organic fine particles, is provided as the outermost layer. Incidentally, in said porous layer comprising organic fine particles, the ratio of said organic fine particles to the solids in said porous layer is preferably more than 50 percent by weight.

It is preferable that said porous layer is almost totally packed with said organic fine particles. The ratio of said organic fine particles to the solids in said layer is preferably more than 50 percent by weight, and is more preferably more than 75 percent. Further, in order to effectively shield it from harmful gases, the porous layer, comprising organic fine particles, is preferably provided as the outermost layer.

A layer comprising said organic fine particles at a high packing ratio generally results in a decrease in the void ratio. Accordingly, when an ink absorptive layer is comprised of a single layer, the thickness of said ink absorptive layer increases. By contrast, a porous layer comprising inorganic fine particles and hydrophilic binders results in a high void ratio, whereby it is possible to absorb a greater amount of ink, employing a thinner layer. As a result, it is preferable to form an ink absorptive layer comprised of both a layer comprising organic fine particles and a porous layer comprising inorganic fine particles and hydrophilic binders. The thickness of said porous layer comprising organic fine particles is preferably from 0.1 to 30 percent with respect to the thickness of said ink absorptive layer, and is more preferably from 0.5 to 20 percent.

From the viewpoint of effectively resulting in discoloration- and fading-minimizing effects, it is preferable that a layer containing organic fine particles at a high concentration is provided. The content ratio in the organic fine particle containing layer is preferably not less than 80 percent by weight, and is more preferably from 90 to 100 percent by weight. Further, said organic fine particle containing layer is preferably the outermost layer of the ink absorptive layer.

A layer containing said organic fine particles in an at least definite amount generally results in a low void ratio. As a result, when the ink absorptive layer is formed utilizing a single layer, the thickness tends to increase to assure the absorption capacity.

By contrast, a porous layer comprised of inorganic fine particles and hydrophilic binders results in a high void ratio. As a result, said porous layer exhibits properties such that a thinner layer can absorb more ink. Accordingly, it is preferable to form an ink absorptive layer comprised of the organic fine particle containing layer together with the porous layer containing inorganic fine particles, as well as hydrophilic binders.

Cited as examples of said inorganic fine particles may be white inorganic pigments such as precipitated calcium carbonate, heavy calcium carbonate, kaolin, clay, talc, calcium sulfate, barium sulfate, titanium dioxide, zinc oxide, zinc hydroxide, zinc sulfide, zinc carbonate, hydrotalcite, aluminum silicate, diatomaceous earth, calcium silicate, magnesium silicate, synthetic non-crystalline silica, colloidal silica, alumina, colloidal alumina, false boehmite, aluminum hydroxide, lithopone, zeolite, and magnesium hydroxide.

In order to achieve high glossiness, the diameter of said inorganic fine particles is preferably from 0.01 to 1 μm, and is more preferably from 0.02 to 0.1 μm.

The inorganic fine particles, as described herein, may be either primary particles or secondary particles. The diameter of said inorganic fine particles refers to the highest order particle diameter observed in the dried layer.

In the present invention, when composite particles comprised of inorganic fine particles and a small amount of organic polymers are employed, said composite particles are commonly designated as inorganic fine particles. In this case, the diameter of said inorganic fine particles also refers to the highest order particle diameter observed in the dried layer. Further, the ratio of organic polymers to inorganic fine particles in said composite particles comprised of inorganic fine particles and a small amount of organic polymers is commonly from 1/100 to 1/4 by weight.

The average diameter of said inorganic fine particles is determined as follows: the cross-section and surface of said porous layer are observed, employing an electron microscope, and the diameter of many randomly selected particles is obtained, whereby said diameter is determined as the simple average value (being the number average value). The diameter of each particle, as described herein, is the diameter of the circle having the same area as the projection area of said particle.

In the present invention, from the viewpoint of achieving lower cost as well as higher reflection density, said fine particles preferably have a lower refractive index. Silica, especially silica synthesized employing a gas phase method (hereafter referred to as a fumed silica), or colloidal silica is more preferred. Further, it is possible to use fumed silica subjected to a cation surface treatment, colloidal silica and alumina subjected to a cation surface treatment, colloidal alumina, pseudo boehmite.

Listed as examples of hydrophilic binders, employed in said ink absorptive layer, are polyvinyl alcohol, gelatin, polyethylene oxide, polyvinylpyrrolidone, polyacrylic acid, polyacrylamide, polyurethane, dextran, dextrin, carrageenan (κ, ι, and λ), agar, Pullulan, water-soluble polyvinyl butyral, hydroxyethyl cellulose, and carboxymethyl cellulose. Said hydrophilic binders may be employed in combination of two or more types. The hydrophilic binder preferably employed in the present invention is polyvinyl alcohol.

In addition to common polyvinyl alcohol which is obtained by hydrolyzing polyvinyl acetate, said polyvinyl alcohol includes modified polyvinyl alcohol which is obtained by being subjected to cationic modification of the terminals, or anionic modification or anion modified polyvinyl alcohol having an anionic group.

The average degree of polymerization of preferably employed polyvinyl alcohol, prepared by hydrolyzing vinyl acetate, is preferably at least 1,000, and is more preferably from 1,500 to 5,000. The saponification ratio is preferably from 70 to 100 percent, and is most preferably from 80 to 99.5 percent.

Said cation modified polyvinyl alcohol includes polyvinyl alcohol having a primary, secondary, or tertiary amino group, or a quaternary ammonium group in its main chain or side chain as described, for example, in Japanese Patent Publication Open to Public Inspection No. 61-10483, and is prepared by copolymerizing an ethylenic unsaturated monomer, having a cationic group, with vinyl acetate.

Two or more polyvinyl alcohols, which are different from each other in the degree of polymerization and modified types, may be employed in combination.

The added amount of inorganic fine particles, employed in said ink absorptive layer, varies markedly depending on the required ink absorption capacity, the void ratio of the porous layer, the types of inorganic fine particles, and the type of hydrophilic binders. However, said added amount is generally from 5 to 30 g per $m^2$ of the recording sheet, and is preferably from 10 to 25 g.

Further, the ratio of inorganic fine particles employed in said ink absorptive layer to the hydrophilic binders is generally from 2:1 to 20:1, and is most preferably from 3:1 to 10:1.

In order to minimize the bleeding of images during storage after recording, cationic polymers are preferably employed.

Cited as examples of cationic polymers may be polyethyleneimine, polyallylamine, polyvinyl amine, dicyandiamide polyalkylene polyamine condensation products, polyalkylene polyamine dicyandiamide ammonium salt condensation products, dicyandiamide formalin condensation products, epichlorohydrin-dialkylamine condensation products, diallyldimethylammonium chloride polymers, diallyldimethylammonium chloride-$SO_2$ copolymers, polyvinylimidazole, vinylpyrrolidone-vinylimidazole copolymers, polyvinylpyridine, polyamidine, chitosan, cationized starch, vinylbenzyltrimethylammonium chloride copolymers, (2-methacroyloxyethyl)trimethylammonium chloride copolymers, and dimethylaminoethyl methacrylate copolymers.

Further, listed as said polymers are cationic polymers described in "Kagaku Kogyo Jiho (Chemical Industry Update)", Aug. 15 and 25, 1998, and polymer dye fixing agents described in "Kobunshi Yakuzai Nyumon (Introduction to Polymer Pharmaceuticals)", published by Sanyo Kasei Kogyo Co., Ltd.

In order to regulate the physical strength of the ink absorptive layer as well as to minimize cracking of the coated layer during coating and drying, it is preferable that hardeners be incorporated into the ink-jet recording sheet of the present invention.

Said hardeners are generally compounds which have a group capable of reacting with said hydrophilic binders, or compounds which promote reaction between different groups of said hydrophilic binders. They are suitably selected and employed depending on the type of hydrophilic binders.

Listed as specific examples of hardeners are, for example, epoxy based hardeners (diglycidyl ethyl ether, ethylene glycol diglycidyl ether, 1,4-butanediol diglycidyl ether, 1,6-diglycidylcyclohexane, N,N-glycidyl-4-glycidylpxyaniline, sorbitol polyglycidyl ether, and glycerol polyglycidyl ether), aldehyde based hardeners (formaldehyde and glyoxal), active halogen based hardeners (2,4-dichloro-4-hydroxy-1,3,5-s-trizine, and bisvinylsulfonyl methyl ether), boric acid and salts thereof, borax, and aluminum alum.

When polyvinyl alcohol and/or cation modified polyvinyl alcohol is employed as the particularly preferred hydrophilic binder, it is preferable that hardeners, selected from boric acid and salts thereof, and epoxy based hardeners are employed. The most preferable hardeners are those selected from boric acid and salts thereof.

Boric acid or salts thereof refer to oxygen acid having a boron atom as the central atom and salts thereof, and specifically include orthoboric acid, diboric acid, metaboric acid, tetraboric acid, pentaboric acid, and octaboric acid, and salts thereof.

The employed amount of said hardeners varies depending on the types of hydrophilic binders, the types of hardeners, the types of inorganic fine particles, and the ratio of the hardeners to the hydrophilic binders. However, said amount is generally from 5 to 500 mg per g of the hydrophilic binder, and is preferably from 10 to 300 mg.

In addition to said additives, various other additives may be incorporated into the ink absorptive layer, as well as other layers which may be desired for the ink recording sheet of the present invention. The following various types of additives, known in the art, cited as incorporated examples may be: polystyrene, polyacrylic acid esters, polymethacrylic acid esters, polyacrylamides, polyethylene, polypropylene, polyvinyl chloride, polyvinylidene chloride, or copolymers thereof; fine organic latex particles of urea resins or melamine resins; various types of cationic or nonionic surface active agents; UV absorbers described in Japanese Patent Publication Open to Public Inspection Nos. 57-74193, 57-87988, and 62-261476; anti-fading additives described in Japanese Patent Publication Open to Public Inspection Nos. 57-74192, 57-87989, 60-72785, 61-146591, 1-95091, and 3-13376; brightening agents described in Japanese Patent Publication Open to Public Inspection Nos. 59-42993, 59-52689, 62-280069, 61-242871, and 4-219266; pH regulators such as sulfuric acid, phosphoric acid, citric acid, sodium hydroxide, potassium hydroxide, and potassium carbonate; antifoaming agents, antiseptics, thickeners, antistatic agents, and matting agents.

Said ink absorptive layer may be comprised of two or more layers. In this case, each ink absorptive layer may be constituted in the same manner.

Suitably employed as supports employed in the present invention may be ink-jet recording sheets known in the art. They may be water-absorptive supports but are preferably non-water-absorptive supports.

Listed as water-absorptive supports capable of being employed in the present invention may be, for example, common paper, cloth, and sheets and boards comprised of wood. Of these, paper is particularly preferred due to the excellent water absorbability of the base material itself, and low cost. Employed as paper supports may be those which are prepared by employing as the main raw materials, chemical pulp such as LBKP and NBKP, mechanical pulp such as GP, CGP, RMP, TMP, CTMP, CMP, and PGW, and wood pulp such as waste paper pulp. Further, if desired, suitably employed as raw materials may be various types of fibrous materials such as synthetic pulp, synthetic fibers, and inorganic fibers.

If desired, various types of additives, known in the art, such as sizing agents, pigments, paper strength enhancing agents, fixing agents, optical brightening agents, wet paper strengthening agents, and cationic agents, may be incorporated into said paper supports.

It is possible to produce paper supports as follows. Fibrous materials such as wood pulp and various additives are blended and the resulting blend is applied to any of the various paper making machines such as a Fourdrinier paper machine, a cylinder paper machine, and a twin wire paper machine. Further, if desired, it is possible to carry out a size press treatment employing starch and polyvinyl alcohol, various coating treatments, and calender finishing during paper making processes or in said paper making machine.

Non-water-absorptive supports capable of being preferably employed in the present invention include transparent supports as well as opaque supports. Listed as said transparent supports are films comprised of materials such as polyester resins, diacetate resins, triacetate resins, acrylic based resins, polycarbonate based resins, polyvinyl chloride based resins, polyimide based resins, cellophane, and celluloid. Of these, when employed for Overhead Projectors, those, which are radiation heat resistant, are preferred, and polyethylene terephthalate is particularly preferred. The thickness of said transparent supports is preferably from 50 to 200 $\mu$m.

Preferred as said opaque supports are, for example, resin coated paper (being so-called RC paper) in which at least one surface of the base paper is covered with a polyolefin resin layer comprised of white pigment, and so-called white PET prepared by incorporating white pigments such as barium sulfate into said polyethylene terephthalate.

For the purpose of enhancing the adhesion between said various supports and the ink absorptive layer, it is preferable that prior to coating said ink absorptive layer, said supports are subjected to a corona discharge treatment, as well as a subbing treatment. Further, the ink-jet recording sheets of the present invention are not always desired to be white and may be tinted.

It is particularly preferable that employed as the ink-jet recording sheets of the present invention be polyethylene laminated paper supports because recorded images approach conventional photographic image quality, and high quality images are obtained at relatively low cost. Said polyethylene laminated paper supports will now be described.

Base paper, employed in said paper supports, are made employing wood pulp as the main raw material, if desired, together with synthetic pulp such as polypropylene and synthetic fiber such as nylon and polyester. Employed as said wood pulp may be any of LBKB, LBSP, NBKP, NBSP, LDP, NDP, LUKP, or NUKP. However, it is preferable that LBKP, NBSP, LBSP, NDP, and LDP, which are comprised of shorter fiber, are employed in a greater amount. However, the ratio of LBSP and/or LDP is preferably from 10 to 70 percent by weight.

Preferably employed as said pulp is chemical pulp (sulfate pulp and sulfite pulp). Further, also useful is pulp which has been subjected to a bleach treatment to increase its whiteness.

Into said base paper suitably incorporated may be sizing agents such as higher fatty acids and alkylketene dimers; white pigments such as calcium carbonate, talc, and titanium oxide; paper strength enhancing agents such as starch, polyacrylamide, and polyvinyl alcohol; optical brightening agent; moisture maintaining agents such as polyethylene glycols; dispersing agents; and softeners such as quaternary ammonium salts.

The degree of water freeness of pulp employed for paper making is preferably from 200 to 500 ml under CSF Specification. Further, the sum of weight percent of 24-mesh residue and weight percent of 42-mesh calculated portion regarding the fiber length after beating, specified in JIS-P-8207, is preferably between 30 and 70 percent. Further, the weight percent of 4-mesh residue is preferably 20 percent by weight or less.

The weight of said base paper is preferably from 30 to 250 g/m$^2$, and is most preferably from 50 to 200 g/m$^2$. The thickness of said base paper is preferably from 40 to 250 $\mu$m.

During the paper making stage or after paper making, said base paper may be subjected to a calendering treatment to result in excellent smoothness. The density of said base paper is generally from 0.7 to 1.2 g/m$^2$ (JIS-P-8118). Further, the stiffness of said base paper is preferably from 20 to 200 g under the conditions specified in JIS-P-8143.

Surface sizing agents may be applied onto the base paper surface. Employed as said surface sizing agents may be the same as those above, capable of being incorporated into said base paper.

The pH of said base paper, when determined employing a hot water extraction method specified in JIS-P-8113, is preferably from 5 to 9.

Polyethylene, which is employed to laminate both surfaces of said base paper, is mainly comprised of low density polyethylene (LDPE) and/or high density polyethylene (HDPE). However, other LLDPE or polypropylene may be partially employed.

Specifically, as is generally done with photographic paper, the polyethylene layer located on the ink absorptive layer side is preferably constituted employing polyethylene into which rutile or anatase type titanium oxide is incorporated so that opacity as well as whiteness is improved. The content ratio of said titanium oxide is generally from 3 to 20 percent by weight with respect to polyethylene, and is more preferably from 4 to 13 percent by weight.

It is possible to employ said polyethylene coated paper as glossy paper. Further, in the present invention, it is possible to employ polyethylene coated paper with a matt or silk surface, as obtained in the conventional photographic paper, by carrying out an embossing treatment during extrusion coating of polyethylene onto said base paper.

In said polyethylene coated paper, it is preferable to maintain a paper moisture content of 3 to 10 percent by weight.

It is possible to apply various types of ink absorptive layers, such as a porous layer and a sublayer, arranged as required, onto a support, employing a method selected from those known in the art. The preferred methods are that the coating composition constituting each layer is applied onto a support and subsequently dried. In this case, it is possible to simultaneously apply two or more layers onto said support, and simultaneous coating is particularly preferred in which all hydrophilic binder layers are simultaneously coated.

Employed as coating methods are a roll coating method, a rod bar coating method, an air knife coating method, a spray coating method, and a curtain coating method. In addition, preferably employed is the extrusion coating method employing a hopper, described in U.S. Pat. No. 2,681,294.

The recording sheet of the present invention tends to easily result in discoloration and fading. Therefore, said recording sheet is preferably employed in the large-sized ink-jet recording field in which a lamination treatment is generally carried out to minimize said discoloration and fading. Accordingly, said recording sheet is preferably wound into a roll at a width of 60 to 180 cm and a length of 10 to 200 m.

When each non-recorded area of the ink-jet recording sheets, described in the invention, is subjected to Bristow's Measurement, the water absorption amount of said non-recorded area is preferably from 10 to 30 ml/m$^2$ during a contact time of 0.8 second.

Listed as specific examples of ejection systems of the ink-jet recording of the present invention may be an electrical-mechanical conversion system (for example, a single cavity type, a double cavity type, a bender type, a piston type, a share mode type, and a shared wall type), an electrical-thermal conversion system (for example, a thermal ink-jet type, and a bubble jet type), and an electrostatic suction type (for example, an electric field control type and a slit jet type), and a discharge system (for example, a spark jet type).

The preferable maximum ink ejection amount of the present invention is from 10 to 35 ml/m$^2$.

The preferable example to constitute the ink-jet recording sheet described in Structure 2 will now be described hereunder. A porous layer comprised of inorganic fine particles and hydrophilic binders is provided on a support. Further, provided is an ink absorptive layer prepared by providing a porous layer packed with organic fine particles having a Tg of at least 60° C., at a high concentration, as the uppermost layer. Plasticizers such as phthalic acid esters may be incorporated into said porous layer, in a small amount. By varying the materials, molecular weight, and content ratio of fine inorganic particles and the types and added amount of said plasticizers, it is possible to prepare the ink-jet recording sheet in which the ink absorptive layer has voids on the uppermost surface and which satisfies the aforementioned General Formula 2.

Further, as one of the specific means to decrease the number of voids on the uppermost surface of the ink absorptive layer and to decrease the void diameter, as described in Structure 19, an ink absorptive layer is preferably prepared through a process in which a coating composition comprising organic fine particle emulsion which satisfies the aforementioned General Formula 4, is applied onto a support and subsequently dried.

In the aforementioned General Formula 4, T0 is the lowest film forming temperature (in ° C.) of said organic fine particle emulsion, and T20 is the lowest film forming temperature (in ° C.) of said organic fine particle emulsion when hydrophilic organic solvent is added to said organic fine particles in an amount of 20 percent by weight.

The lowest film forming temperature of organic fine particle emulsion will now be described.

The lowest film forming temperature of organic fine particle emulsion, as described herein, may be determined utilizing the method described in ISO 2115.

During preparation of said organic fine particle emulsion, when hydrophilic organic solvent is directly added to said emulsion, localized coagulation occasionally occurs. For the purpose of minimizing said coagulation, it is preferable that water-diluted hydrophilic organic solvent is added. Water may be added in the same amount as the volume of said emulsion, since determination of the lowest film forming temperature is not adversely affected.

In the present invention, materials of said organic fine particle emulsion, which satisfies the aforementioned General Formula 4, are not particularly limited. Employed as said materials may be those, conventionally known in the art, such as polyvinyl chloride, polyvinylidene chloride, polyacrylate, polymethacrylate, elastomer, ethylene-vinyl acetate copolymers, styrene-acryl copolymers, styrene-methacrylic copolymers, polyester, polyvinyl ether, polyvinyl acetal, polyamide, polyurethane, polyolefin, SBR, NBR, polytetrafluoroethylene, chloroprene, proteins, polysaccharides, rosin ester, and shellac resins.

Of these, particularly preferable organic fine particle materials include polyvinyl acetal based resins, polyurethane based resins, rosin ester based resins, styrene-acryl copolymers, styrene-methacryl copolymers, and SBR. Employed may be those in which a specific modifying group is added to resins or a leaving group is removed. Organic fine particles may be formed upon mixing at least two types of materials, and further, at least two types of organic fine particles may be blended and employed.

In order to maintain dispersion stability, dispersing agents and surface active agents are preferably incorporated into said organic fine particle emulsion. Self-emulsifying type emulsions, in which a hydrophilic group is added to the molecular chain, may be employed.

Listed as means to control the lowest film forming temperature of said organic fine particle emulsion, as well as organic fine particle emulsion added with said hydrophilic organic solvent, are those to control materials of organic fine particles, monomer compositions, molecular weight, the amount of dispensing agents, and particle diameter.

EXAMPLES

The present invention will now be specifically described with reference to examples. However, the embodiments of the present invention are not limited to these examples. Incidentally, "percent" in the examples shows percent by absolutely dried weight, unless otherwise specified.

(Preparation of Organic Fine Particle Dispersion 1)

Both Solutions A and B, described below, were heated to 70° C., and mixed. Immediately after mixing, the resulting mixture was subjected to emulsified dispersion employing a table-top homogenizer, and methylene chloride was volatilized under a reduced pressure. The solid concentration of the resulting Organic fine particle Dispersion 1 was 10 percent, and the number average particle diameter determined through measurement of the laser diffraction scattering particle size distribution was 1.2 $\mu$m.

| | |
|---|---|
| Solution A | |
| Polyvinyl butyral (BL-S, manufactured by Sekisui Kagaku) | 10 parts |
| Methylene chloride | 50 parts |
| Solution B | |
| Surface active agent (Emulgen 220, manufactured by Kao) | 0.2 part |
| Water | 100 parts |

(Preparation of Silica-Cation Polymer Dispersion 1)

Solutions A and B, described below, were mixed, and the resulting mixture was blended with Solution C, described below. The resulting mixture was dispersed under a pressure of 500 kg/cm$^2$, employing a high pressure homogenizer (manufactured by Sanwa Kogyo Co., Ltd.), whereby transparent Silica-Cation Polymer Dispersion 1 was prepared.

| | |
|---|---|
| Solution A | |
| fumed silica (300, manufactured by Nippon Aerosil) | 125 parts |
| Water | 620 parts |
| Nitric acid | amount to adjust the pH of Solution A to 2.5 |
| Solution B | |
| Cation Polymer-1 | 15 parts |
| Ethanol | 40 parts |
| Water | 180 parts |
| Nitric acid | amount to adjust the pH of Solution B to 2.5 |
| Solution C | |
| Boric acid | 2.6 parts |
| Sodium tetraborate + hydrate | 2 parts |
| Water | 70 parts |

Cation Polymer 1

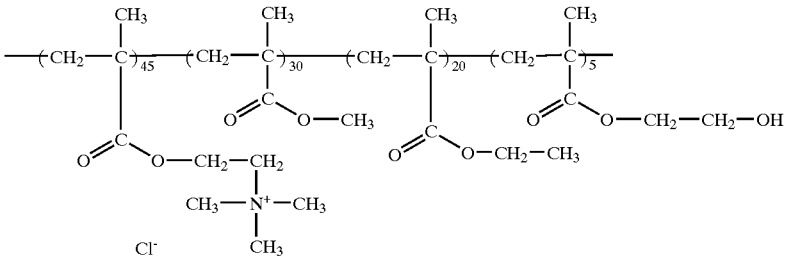

(Preparation of Ink-Jet Recording Sheet 1)

Applied onto a paper support (at a thickness of 230 mm), laminated with polyethylene on both sides, was Coating Composition 1 comprised of the composition described below, employing a wire bar, while maintaining said Coating Composition 1 at 45° C., and the coating was dried. Then, the resulting coating was stored in a thermostat maintained at 40° C. and relative humidity 80 percent for 12 hours, whereby Ink-jet Recording Sheet 1 was prepared. The dried layer thickness was 40 μm. Incidentally, hereinafter, an ink-jet recording sheet is referred to as a recording sheet.

Coating Composition 1

| | |
|---|---|
| Silica-Cation Polymer Dispersion 1 | 100 parts |
| Polyvinyl alcohol (PVA203, manufactured by Kuraray) | 0.05 part |
| Polyvinyl alcohol (PVA235, manufactured by Kuraray) | 2.2 parts |
| Water | 40 parts |

(Preparation of Recording Sheet 2)

Organic fine particle Dispersion 1 was applied onto Recording Sheet 1, employing a wire bar and subsequently dried, whereby Recording Sheet 2 was prepared. The thickness of the layer, comprised of organic fine particles, was 2 μm.

(Preparation of Recording Sheet 3)

Organic fine particle Dispersion 1 was applied onto Recording Sheet 1, employing a wire bar and subsequently dried, whereby Recording Sheet 3 was prepared. The thickness of the layer, comprised of organic fine particles, was 8 μm.

(Preparation of Recording Sheet 4)

Organic fine particle Dispersion 1 was applied onto Recording Sheet 1, employing a wire bar and subsequently dried, whereby Recording Sheet 4 was prepared. The thickness of the layer comprised of organic fine particles was 12 μm.

(Preparation of Recording Sheet 5)

Coating Composition 2 was prepared by mixing 40 parts of Coating Composition 1 with 60 parts of Organic fine particle Dispersion 1. Coating Composition 2 was applied onto Recording Sheet 1, employing a wire bar and subsequently dried, whereby Recording Sheet 5 was prepared. The thickness of the layer comprised of organic fine particles was 8 μm.

(Preparation of Recording Sheet 6)

Coating Composition 3 was prepared by mixing 70 parts of Coating Composition 1 with 30 parts of Organic fine particle Dispersion 1. Coating Composition 3 was applied onto Recording Sheet 1, employing a wire bar and subsequently dried, whereby Recording Sheet 6 was prepared. The thickness of the layer comprised of organic fine particles was 8 μm.

(Preparation of Recording Sheet 7)

Polyvinyl butyral emulsion (at an average particle diameter of 0.5 μm, Rejem VB J-667, manufactured by Chukyo Yushi) was applied onto Recording Sheet 1, employing a wire bar and subsequently dried, whereby Recording Sheet 7 was prepared. The thickness of the layer comprised of said polyvinyl butyral was 2 μm.

(Preparation of Recording Sheet 8)

Urethane based emulsion (at an average particle diameter of 0.96 μm, Superflex E-2500, manufactured by Daiichi Kogyo Seiyaku) was applied onto Recording Sheet 1, employing a wire bar and subsequently dried, whereby Recording Sheet 8 was prepared. The thickness of the layer comprised of said urethane based emulsion was 2 μm.

(Preparation of Recording Sheet 9)

Styrene (metha)acryl based emulsion (at an average particle diameter of 0.15 μm, Polytoron E390M, manufactured by Asahi Kasei Kogyo) was applied onto Recording Sheet 1, employing a wire bar and subsequently dried, whereby Recording Sheet 9 was prepared. The thickness of the layer comprised of said styrene (metha)acryl based emulsion was 2 μm.

(Preparation of Recording Sheet 10)

Styrene-butadiene based emulsion (at an average particle diameter of 0.1 μm, Nipol LX433C, manufactured by Nihon Zeon) was applied onto Recording Sheet 1, employing a wire bar and subsequently dried, whereby Recording Sheet 10 was prepared. The thickness of the layer comprised of said styrene-butadiene based emulsion was 2 μm.

(Preparation of Recording Sheet 11)

Polystyrene latex emulsion (at an average particle diameter of 0.16 μm) was applied onto Recording Sheet 1, employing a wire bar and subsequently dried, whereby Recording Sheet 11 was prepared. The thickness of the layer comprised of said polystyrene latex emulsion was 2 μm.

(Electron Microscope Observation of Organic Fine Particles)

The surface and cross-section of each of Recording Sheets 1 through 11 were observed employing an electron microscope. It was then verified that a porous layer comprised of particles and spaces was formed on the surface and cross-section of each Recording Sheet.

(Solubility Test of Organic Fine Particles)

Organic fine particles and each of the emulsion employed in Recording Sheets 2 through 11 were mixed at room temperature with diethylene glycol monobutyl ether (having an SP value of 19.437 $(MPa)^{1/2}$ and a boiling point of 230° C.). All emulsions, except the polystyrene latex emulsion, employed in Recording Sheet 11, were dissolved. On the other hand, the same test was conducted employing glycerin (having an SP value of 33.759 $(MPa)^{1/2}$ and a boiling point of 290° C.) All types of organic fine particles were not dissolved.

(Preparation of Ink Composition 1)

Ink Composition 1, having the composition described below, was prepared.

| | |
|---|---|
| Water | 68.5 parts |
| Diethylene glycol monobutyl ether | 12 parts |
| Diethylene glycol | 10 parts |
| Glycerin | 8 parts |
| C.I. Direct Blue 86 | 1 part |
| Surface active agent (Surfinol 465, manufactured by Shin-Etsu Kagaku) | 0.5 part |

(Evaluation)

Recording Sheets 1 through 11 were subjected to the following process.

Process 1

Ink Composition 1 was placed in an ink-jet printer MJ-800C (manufactured by Seiko-Epson Co., Ltd.) and was ejected onto each of Recording Sheets 1 through 11 so as to form a solid image. The amount of ejected ink was 12 $ml/m^2$. The resulting image was dried at 23° C. and 55 percent relative humidity for one hour.

Process 2

Onto each surface of Recording Sheets 1 through 11, spray-coated uniformly was a 20 percent aqueous diethylene glycol monobutyl ether solution. The coated amount was 20 $ml/m^2$. The resulting coating was dried at 23° C. and 55 percent relative humidity for one hour.

Process 3

Onto each surface of Recording Sheets 1 through 11, spray-coated uniformly was a 20 percent aqueous glycerin solution. The coated amount was 20 $ml/m^2$. The resulting coating was dried at 23° C. and 55 percent relative humidity for one hour.

Bristow's Measurement (Measurement of Water Absorption Amount)

The areas of Recording Sheets 1 through 11, some of which had been and had not been subjected to Processes 1 through 3 were subjected to Bristow's Measurement (in units of $ml/m^2$). The contact time was 0.8 second and the employed liquid was a 0.05 percent aqueous C.I. Acid Red 52 solution.

Recording Sheets 1 through 11, which had been subjected to Process 1, were posted next to a window in an office, which was exposed to exterior air flow but was not exposed to direct sun light, and were left untouched for 6 months. The density of the printed area before and after posting was measured utilizing red monochromatic light and the ratio (the residual ratio) of the density before posting to that after posting was obtained.

Table 1 shows the measurement and evaluation results.

TABLE 1

| Recording Sheet | Bristow's Measurement: No Applied Process | Process 1 | Process 2 | Process 3 | Discoloration and Fading (in %) | Remarks |
|---|---|---|---|---|---|---|
| Recording Sheet 1 | 19.7 | 16.8 | 15.7 | 14.3 | 63 | Comparative Example |
| Recording Sheet 2 | 18.4 | 7.0 | 5.4 | 12.4 | 94 | Present Invention |
| Recording Sheet 3 | 16.3 | 5.1 | 4.3 | 11.7 | 97 | Present Invention |
| Recording Sheet 4 | 12.4 | 3.7 | 2.2 | 7.8 | 98 | Present Invention |
| Recording Sheet 5 | 19.2 | 6.5 | 5.4 | 13.4 | 90 | Present Invention |
| Recording Sheet 6 | 19.8 | 7.8 | 7.2 | 14.1 | 86 | Present Invention |
| Recording Sheet 7 | 17.8 | 6.7 | 6.2 | 12.1 | 97 | Present Invention |
| Recording Sheet 8 | 18.3 | 6.9 | 6.3 | 12.7 | 95 | Present Invention |
| Recording Sheet 9 | 16.9 | 4.9 | 5.3 | 13.1 | 84 | Present Invention |
| Recording Sheet 10 | 15.7 | 4.1 | 4.1 | 12.2 | 84 | Present Invention |
| Recording Sheet 11 | 17.0 | 9.3 | 7.5 | 13.5 | 66 | Comparative Example |

Table 1 clearly shows that Recording Sheets 2 through 10, when being subjected to Process 1 (ink application), resulted in Va/Vb of no more than 0.4 and improvement of discoloration and fading, whereby the ink-jet recording method of the present invention exhibited excellent effects. Further, Table 1 also shows that Recording Sheets 2 through 10, when being subjected to Process 2 (aqueous solution application), resulted in Vc/Vd of no more than 0.4, whereby the ink-jet recording sheets of the present invention also exhibited excellent effects.

Further, as can be seen from Table 1, the discoloration and fading are minimized by forming, as the uppermost layer, a porous layer comprised of fine non-water-soluble organic particles which are soluble in water-soluble organic solvents in the ink, whereby the ink-jet recording method of the present invention exhibits excellent effects. Still further, it is found that by forming a porous layer comprised of fine non-water-soluble organic particles which are soluble in water-soluble organic solvents having an SP value of 18.414 to 30.69 $(MPa)^{1/2}$ and a boiling point of at least 120° C., the ink-jet recording sheets of the present invention also exhibit excellent effects.

The present invention exhibits excellent effects, in which an ink-jet recording sheet, comprising a porous type ink absorptive layer having a high ink absorption rate, results in minimization of image degradation such as minimization of discoloration and fading due to harmful gases without application of any particular treatment.

Example 2

<<Preparation of Ink-Jet Recording Sheet>>

(Preparation of Ink-Jet Recording Sheet 2-1)

Applied onto a paper support (at a thickness of 230 mm), laminated with polyethylene on both sides, was Coating Composition 1 comprised of the composition, described below, employing a wire bar, while maintaining said Coating Composition 1 at 45° C., and the coating was dried. Thereafter, the resulting coating was stored in a thermostat maintained at 40° C. and relative humidity 80 percent for 12 hours, whereby Ink-jet Recording Sheet 2-1 was prepared. The dried layer thickness was 40 μm.

(Coating Composition 1)

| | |
|---|---|
| Silica-Cation Polymer Dispersion 1 | 100 parts |
| Polyvinyl alcohol (PVA203, manufactured by Kuraray) | 0.05 part |
| Polyvinyl alcohol (PVA235, manufactured by Kuraray) | 2.2 parts |
| Water | 40 parts |

Silica-Cation Polymer Dispersion 1 was prepared as described below.

(Preparation of Silica-Cation Polymer Dispersion 1)

Solution A and Solution B, described below, were mixed, and the resulting mixture was blended with Solution C, as described below. The resulting mixture was dispersed under a pressure of 49.03 MPa, employing a high pressure homogenizer (manufactured by Sanwa Kogyo Co., Ltd.), whereby transparent Silica-Cation Polymer Dispersion 1 was prepared.

| | |
|---|---|
| (Composition of Solution A) | |
| Fumed silica (300, manufactured by Nippon Aerosil) | 125 parts |
| Water | 620 parts |
| Nitric acid | amount to adjust the pH of Solution A to 2.5 |
| (Composition of Solution B) | |
| Cation Polymer-1 | 15 parts |
| Ethanol | 40 parts |
| Water | 180 parts |
| Nitric acid | amount to adjust the pH of Solution B to 2.5 |
| (Composition of Solution C) | |
| Boric acid | 2.6 parts |
| Sodium tetraborate + hydrate | 2 parts |
| Water | 70 parts |

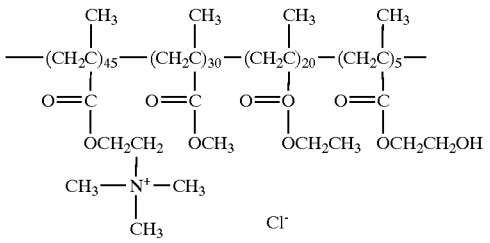

(Preparation of Ink-Jet Recording Sheets 2-2 through 2-7)

Each of Organic fine particles Emulsions L1 through L6, shown in Table 2, was adjusted so as to result in the lowest film forming temperature (T0 and T20); subsequently applied onto said Ink-jet Recording Sheet 2-1; and dried at 40° C., whwereby Ink-jet Recording Sheets 2-2 through 2-7 were prepared. The thickness of all organic fine particle containing layers was adjusted to 1 μm.

Further, the lowest film forming temperature of each organic fine particle emulsion was determined as described below.

(Measurement of Lowest Film Forming Temperature)

Lowest film forming temperature T0 of each of Organic Fine Particle Emulsions L1 though L6 was measured in accordance with the method described in ISO 2115. Further, 20 percent aqueous diethylene glycol monobutyl ether solution was added to each of L1 through L6 in the same amount as the weight of each solids, and the lowest film forming temperature T20 of each resulting mixture was determined in the same manner as above. The resulting T0 and T20 are described in Table 2.

TABLE 2

| Composition of Organic fine particle | Material of Organic fine | Lowest Film Forming Temperature (in ° C.) | |
|---|---|---|---|
| Emulsion | particles | T0 | T20 |
| L1 | acryl based emulsion | 80 | 10 |
| L2 | urethane based emulsion | 75 | 0 |
| L3 | acryl based emulsion | 65 | 10 |
| L4 | acryl based emulsion | 55 | 5 |
| L5 | acryl-styrene based emulsion | 100 | 90 |
| L6 | urethane based emulsion | 20 | −10 |

(Preparation of Ink-Jet Recording Sheets 2-8 through 2-11)

Organic Fine Particle Emulsion L3 and Silica-Cation Polymer Dispersion 1 were mixed and adjusted so that the ratio (by weight) of organic fine particles to the solids in the mixture reaches the values shown in Table 3. Each of the resulting mixtures was applied onto Ink-jet Recording Sheet 2-1 and subsequently dried at 40° C., whereby Ink-jet Recording Sheets 9 through 12 were prepared. Table 3 shows the dried thickness of the layers containing said organic fine particles.

TABLE 3

| Ink-jet Recording Sheet | Content Ratio (Organic fine particles/Total Solids) | Dried Layer Thickness (in μm) |
|---|---|---|
| 2-8 | 0.8 | 1 |
| 2-9 | 0.6 | 1 |
| 2-10 | 0.4 | 2 |
| 2-11 | 0.2 | 5 |

Ink-jet Recording Sheets 2-1 through 2-11, prepared as above, were subjected to evaluation by each of Bristow's Measurement, electron microscopy, and discoloration and fading.

<<Bristow's Measurement>>

Ink-jet Recording Sheets 2-1 through 2-11 were subjected to Bristow's measurement, whereby Vd was obtained. Further, after storing said recording sheets at 60° C. and 20% RH for 24 hours, each of the resulting recording sheets was subjected to Bristow's Measurement in the same manner as above, whereby V60 was obtained. Further, 10 weight percent aqueous diethylene glycol monobutyl ether solution was spray-coated onto each surface of said recording sheet at an amount of 2 ml/m$^2$ and subsequently dried at 23° C. and 55 percent relative humidity. Thereafter, the resulting recording sheet was subjected to Bristow's Measurement in the same manner as above, whereby Vc was obtained.

Table 4 shows Vc/Vd and V60/Vd values.

Incidentally, a 0.25 percent aqueous C.I. Acid Red 52 solution was employed for Bristow's Measurement. Among prepared ink-jet recording sheets, Ink-jet Recording Sheet 2-7 resulted in markedly low water absorption which made it impossible to conduct Vd determination. Accordingly, Ink-jet Recording Sheet 2-7 was not subjected in said evaluation.

<<Observation of Voids: Electron Microscopic Observation>>

Each surface of Ink-jet Recording Sheets 2-1 through 2-11 was observed utilizing an electron microscope, and no voids were noticed on the surface of Recording Sheet 2-7. By contrast, in other recording sheets, presence of voids among particles was noticed. Further, the surface of recording sheets provided with diethylene glycol monobutyl ether was observed utilizing an electron microscope, and it was noted that all recording sheets of the present invention resulted in a decrease in the number of voids or a decrease in said void's diameter.

<<Evaluation of Discoloration and Fading: Evaluation of Residual Density>>

Ink Composition 1, prepared as described below, was placed in an ink-jet printer MJ-800C (manufactured by Seiko-Epson Co., Ltd.) and each of Ink-jet Recording Sheets 2-1 through 2-11 was subjected to solid image recording (through ink ejection). At the same time, the ink ejection amount was adjusted to reach 12 ml/m$^2$.

Each of resulting solid images was dried for one hour at 23° C. and 55 percent relative humidity, as well as at 10° C. and 55 percent relative humidity. Subsequently, the resulting images were posted next to a window in an office, which was exposed to exterior air flow but was not exposed to direct sun light, and were left untouched for 6 months After posting, the reflection density of the image area was measured utilizing red monochromatic light, and the ratio (the residual ratio) of the density before posting to that after posting was obtained. Incidentally, Ink-jet Recording Sheet 2-7 barely absorbed ink, and was therefore not subjected to evaluation of discoloration and fading.

(Preparation of Ink Composition 1)

Ink Composition 1, comprised of the composition described below, was prepared.

| | |
|---|---|
| Water | 68.5 parts |
| Ethylene glycol monobutyl ether | 12 parts |
| Diethylene glycol | 10 parts |
| Glycerin | 8 parts |
| C.I. Direct Blue 86 | 1 part |
| Surface active agent (Surfinol 465, manufactured by Shin-Etsu Kagaku) | 0.5 part |

The primary component of hydrophilic organic solvents employed in said Ink Composition 1 is diethylene glycol monobutyl ether. In the present example, diethylene glycol monobutyl ether is employed for Bristow's measurement.

Table 4 shows the obtained evaluation results.

TABLE 4

| Ink-jet Recoding Sheet | Bristow's Measurement Vc/Vd | Bristow's Measurement V60/Vd | Residual Density Ratio Drying at 23° C. | Residual Density Ratio Drying at 10° C. | Remarks |
|---|---|---|---|---|---|
| 2-1 | 0.85 | 1.00 | 61% | 64% | Comparative Example |
| 2-2 | 0.05 | 0.85 | 100% | 98% | Present Invention |
| 2-3 | 0.10 | 0.80 | 99% | 96% | Present Invention |
| 2-4 | 0.20 | 0.75 | 98% | 94% | Present Invention |
| 2-5 | 0.20 | 0.05 | 97% | 71% | Comparative Example |
| 2-6 | 0.65 | 0.95 | 63% | 62% | Comparative Example |
| 2-7 | — | — | — | — | Comparative Example |
| 2-8 | 0.25 | 0.80 | 95% | 90% | Present Invention |
| 2-9 | 0.30 | 0.85 | 93% | 90% | Present Invention |
| 2-10 | 0.30 | 0.90 | 92% | 91% | Present Invention |
| 2-11 | 0.25 | 0.90 | 94% | 92% | Present Invention |

*Ink-jet Recording Sheet 2-7 resulted in no ink absorption.

As can clearly be seen from Table 4, samples of the present invention exhibited excellent ink absorbability and resulted in markedly minimal discoloration and fading.

According to the present invention, it is possible to provide an ink-jet recording sheet which exhibits excellent ink absorbability and results in minimal image degradation due to harmful gases and a method for producing the same.

What is claimed is:

1. An ink-jet recording sheet comprising:

a non-water-absorptive support; and an ink absorbing layer thereon, the ink absorbing layer including a first porous layer at the outermost position of the ink-jet recording sheet, including water-insoluble organic particles having a mean primary particle diameter of not more than 0.1 $\mu$m, the first porous layer having a thickness not more than 20% of the thickness of the ink absorbing layer, and a second porous layer positioned between the support and the first porous layer, the second porous layer including inorganic particles having an average particle diameter of 0.02 to 0.1 $\mu$m wherein the ink-jet recording sheet satisfies the following Formula (1), when an aqueous solution, which comprises a water-soluble alcohol-type organic solvent having an SP value in a range of from 18.414 to 30.69 (Mpa)$^{1/2}$ and a boiling point of not less than 120° C. in an amount of from 10 to 40% by weight, is provided to the surface of the ink-jet recording sheet in an amount of 20 ml/m$^2$, $$Vc/Vd \leq 0.4 \qquad \text{Formula (1)}$$

wherein VC represents a water transition amount of a first area of the ink-jet recording sheet, where the aqueous solution is provided, during a contact time of 0.8 seconds when the first area is subjected to Bristow's Measurement, and Vd represents a water transition amount of a second area of the ink-jet recording sheet, where the aqueous solution is not provided, during a contact time of 0.8 seconds when the second are is subjected to Bristow's Measurement.

2. The ink-jet recording sheet of claim 1, wherein the ink-jet recording sheet further satisfies the following Formula (2), $$V60/Vd \geqq 0.7 \qquad \text{Formula (2)}$$

Vd represents a water transition amount of the ink-jet recording sheet during a contact time of 0.8 seconds when the ink-jet recording sheet is subjected to Bristow's Measurement after being stored at 60° C. and 20 RH for 24 hours.

3. The ink-jet recording sheet of claim 1, wherein the water-insoluble organic particles, are capable of being dissolved in or swelled by a water-soluble alcohol-type organic solvent having an SP value in a range of from 18.414 to 30.69 $(Mpa)^{1/2}$ and a boiling point of 120° C. or more, the second porous layer further includes a hydrophilic binder.

4. The ink-jet recording sheet of claim 1, wherein the water-soluble alcohol-type organic solvent is diethylene glycol monobutyl ether.

5. The ink-jet recording sheet of claim 4, wherein the water-insoluble organic particles are capable of being dissolved in or swelled by the diethylene glycol monobutyl ether, and the water-insoluble organic particles have a mean primary diameter of not more than 0.1 $\mu$m.

6. The ink-jet recording sheet of claim 1, wherein the second porous layer has a thickness not less than 80% of the thickness of the ink absorbing layer.

7. The ink-jet recording sheet of claim 1, wherein the second porous layer further includes a binder.

* * * * *